United States Patent [19]

Sapone

[11] Patent Number: 4,686,339

[45] Date of Patent: Aug. 11, 1987

[54] SNAP-ON ACTUATOR FOR TOGGLE SWITCH

[75] Inventor: Frank P. Sapone, Waterbury, Conn.

[73] Assignee: Carlingswitch, Inc., West Hartford, Conn.

[21] Appl. No.: 832,868

[22] Filed: Feb. 24, 1986

[51] Int. Cl.[4] ..... H01H 3/20; H01H 21/02

[52] U.S. Cl. ..... 200/339; 200/330

[58] Field of Search ..... 200/339, 333, 331, 330, 200/340, 332, 337, 338, 336, 329, 43.04

[56] References Cited

U.S. PATENT DOCUMENTS

| | | | |
|---|---|---|---|
| 1,603,523 | 10/1926 | Douglas | 200/338 |
| 2,807,692 | 9/1957 | Leslie | 200/333 |
| 3,773,997 | 11/1973 | Evans et al. | 200/330 X |
| 3,959,618 | 5/1976 | Carroll | 200/339 |
| 4,242,551 | 12/1980 | Sorenson | 200/331 X |
| 4,283,613 | 8/1981 | Kondo et al. | 200/340 |
| 4,367,386 | 1/1983 | Sorenson | 200/333 |
| 4,370,532 | 1/1983 | Green | 200/333 X |
| 4,440,994 | 4/1984 | Nat | 200/43.04 |
| 4,454,797 | 6/1984 | Kim | 200/330 X |

FOREIGN PATENT DOCUMENTS

| | | | |
|---|---|---|---|
| 270048 | 5/1927 | United Kingdom | 200/329 |
| 847851 | 9/1960 | United Kingdom | 200/43.04 |

*Primary Examiner*—Stephen Marcus
*Assistant Examiner*—Ernest G. Cusick
*Attorney, Agent, or Firm*—McCormick, Paulding & Huber

[57] ABSTRACT

A snap-on actuator for use with a miniature switch of the type usually fitted with a toggle. The toggle is shortened and has a slot for receiving a C-shaped retainer. The retainer holds the actuator on the toggle and prevents the toggle from being moved inwardly of the switch case as a result of downward force on the actuator.

2 Claims, 6 Drawing Figures

SNAP-ON ACTUATOR FOR TOGGLE SWITCH

This invention relates generally to electrical switches, and deals more particularly with a miniature toggle switch of the type having an abbreviated toggle stem projecting outwardly through an opening defined in the cover portion of the switch.

More particularly this cover portion of the switch generally includes an upstanding bushing, and in accordance with the present invention the bushing has flats on opposite sides that cooperate with skirts provided on the actuator to prevent rotation of the toggle when the snap-on actuator is provided thereon.

BACKGROUND OF INVENTION

Miniature toggle switches of the prior art have been provided with base portions of insulating material and either metal or plastic bushing portions mechanically attached or otherwise mounted to the plastic base. Such switches generally have an elongated toggle actuator of conventional configuration. That is, the toggle extends well beyond the bushing and is provided with a generally spherical shoulder portion inside the bushing the cooperates with an inside flange on the bushing itself. A spring loaded plunger or the like is provided on the inner end of the toggle to exert a downward force on the movable contact lever in the switch case. Thus, the toggle itself is spring loaded upwardly so that the spherical shoulder engages the flange inside of the bushing and the spring loaded plunger provides a lost motion connection between the toggle and the movable contact inside the switch.

In order to provide a rocker style actuator on such switches or in order to provide any type of actuator other than a toggle, the prior art teaches that a plastic mounting bracket or a metal mounting bracket be provided in addition to the switch case cover, which bracket defines upstanding ears having aligned openings in the ears for receiving projections in the actuator in order to provide adequate support for the actuator separate and apart from the toggle itself. Such a construction has proven very expensive to fabricate and assemble and as a result other improvements have been suggested. One such improvement is shown in U.S. Pat. No. 4,367,386 issued to assignee herein.

This patent provides a convenient snap-on actuator for a miniature toggle switch of otherwise standard configuration wherein no additional mounting means is necessary for pivotally supporting the actuator and wherein the actuator is prevented from rotating relative to the switch case by providing flats on the upstanding boss or bushing and cooperating inwardly facing skirt side walls on the rocker actuator. However this patent also suggests that the actuator be provided with integrally molded guide surfaces that cooperate with the top of the bushing itself in order to prevent the toggle from being moved out of its pivot position as a result of excessive forces on the rocker actuator during switching.

The present invention provides many of the same advantages achieved in the above mentioned prior art U.S. Pat. No. 4,367,386, and in addition provides for a more secure connection between the rocker actuator and the toggle, all without resort to prior art pivot brackets and the like and/or to the prior art pin connections sometimes provided between the boss and the spherical shoulder portion of the actuator to restrict movement of the toggle to its intended pivotal motion.

Toggle switches of the miniature type when equipped with a rocker actuator can be expected to suffer from a disadvantage in that the toggle is free to move axially of its length as a result of the lost motion connection provided by the conventional spring and plunger mechanism inside the switch or other equivalent lost motion connections. Prior art miniature toggle switches generally resort to pinning of the toggle to the boss of the switch case, or resort to the expensive brackets sometimes provided for in such switches to independently support the rocker, or to the solution suggested in U.S. Pat. No. 4,367,386.

SUMMARY OF INVENTION

In accordance with the present invention the miniature toggle switch is provided with flats on the bushing or boss normally provided on the swithc case cover, and the toggle has an annular flange that has an interference fit with an annular groove in the actuator. The toggle is further joined to the actuator by a flat C-shaped retainer that has a side opening forming an interference fit with an annular groove in the toggle. The retainer is provided close to the top of the switch case bushing so that at least in limit positions of the actuator the retainer actually abuts the bushing to prevent undesirable downward movement of the toggle inside the switch case as the actuator is moved out of one of its two limit positions. The retainer is preferably a C-shaped plate with the open side adapted to fit into an annular groove in the toggle. The ends of the retainer plate may be received in slots defined in the actuator to supplement the holding action of the flange and groove, or to serve as the sole connection means between the actuator and toggle.

DETAILED DESCRIPTION OF EMBODIMENTS OF FIGS. 1, 2 AND 3

Figure 1:
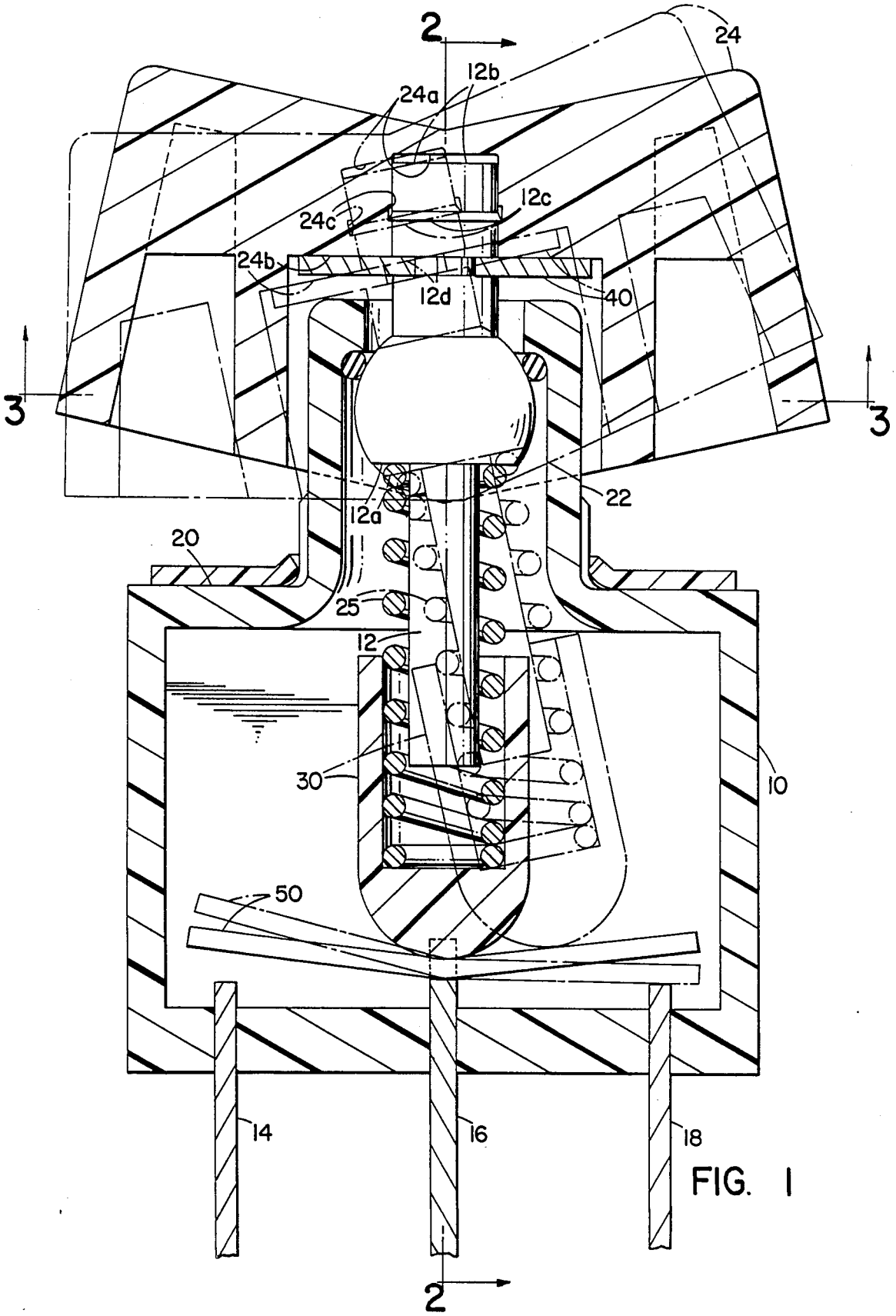
FIG. 1 is a vertical sectional view taken through a miniature toggle switch constructed in accordance with the present invention and shows certain parts in alternative positions in broken lines.

Turning now to the drawings in greater detail, FIG. 1 shows a miniature switch constructed in accordance with the present invention and comprising a switch case 10 of the type having an upwardly open lower portion defining a cavity for the spring biased plunger 30, several fixed contacts 14, 16 and 18, and movable contact 50. Movable contact 50 is adapted to be shifted between at least two limit positions as a result of manually moving the rocker actuator 24 through the solid line center position shown to the broken line position and to a mirror image of the broken line position (not shown) when the rocker actuator 24 is moved in the opposite direction.

The switch of FIG. 1 is a two position type in that the center position is an unstable one, that is the rocker and toggle together with the associated movable contact lever 50 will tend to assume one or the other of the alternative limit positions as suggested by the broken lines in FIG. 1 and in the preceding paragraph. This action of the toggle element 12 is conventional and can be attributed to the fact that toggle 12 has a generally spherically shaped shoulder 12*a* engaging an annular flange inside the generally cylindrical upstanding boss or bushing 22 provided as part of the cover portion 20 of the switch case. In accordance with conventional design practice for toggle switches generally a spring 25 is provided between the underside of the shoulder 12*a* and the top of a movable plunger or tip element 30. The plunger 30 is slidably received on the lower end of the toggle element 12 for this purpose. That is, the combination of pivoting toggle element 12 together with the spring 25 and plunger element 30 provides a lost motion connection between the movable contact 50 and the rocker actuator 24 to provide stable limit positions for both the rocker and the movable contact 50 while permitting the necessary lost motion to achieve movement between the switch positions referred to above.

In a conventional miniature toggle switch the toggle element 12 has an upwardly extending bat portion (as an extension of the post 12*b*) and various switch positions can be achieved simply by pivoting this upwardly extending bat portion as desired. In accordance with the present invention such an upwardly extending bat portion of the toggle element 12 is replaced by the rocker actuator 24. In order to provide an operable rocker switch in place of such a conventional toggle switch the rocker must be so secured to the toggle element 12 that downward force on the rocker 24 will not overcome the force of the spring 25 acting on the toggle 12 to urge the shoulder 12*a* upwardly into engagement with the flange inside the bushing 22.

Prior art approaches to this problem have involved additional bracket assemblies provided above the cover 20 and defining aligned openings for receiving projections on the rocker itself. Other designs have involved more esoteric configurations some of which are suggested in the prior art U.S. Pat. No. 4,367,386 mentioned previously.

These various prior art design configurations all have certain disadvantages, and the rocker actuator switch configuration to be descirbed represents an improvement over these prior art switch configurations that provides a rocker mounting arrangement rugged enough to withstand the downward force applied by the user of the switch in changing the switch condition without resort to the expensive and complicated rocker pivoting arrangements heretofore suggested for preventing inadvertent downward or inward movement of the toggle relative to the switch case as the rocker is manipulated by the user.

In accordance with the present invention rocker 24 has a downwardly open cavity 24*a* for receiving the upper post end 12*b* of the toggle element. The toggle element and the rocker 24 are held in assembled relationship with one another by means of an annular flange on the post and an annular groove in the rocker cavity. The annular flange is preferably in the form of an annular rib 12*c* provided on the toggle post, which rib has an inclined edge, so as to be received during assembly in the annular groove. The groove is preferably provided in the form of an annular slot 24*c* provided in the downwardly open recess 24*a* of the rocker 24. While this means for attachment of the rocker to the toggle element is similar in some respects to that suggested in prior art U.S. Pat. No. 4,367,386 the present invention further comprises a generally C-shaped spring metal retaining element 40 provided in an annular slot 12*d* in the toggle element 12. As will be apparent from FIGS. 1 and 2 this C-shaped retaining element or plate 40 has an upper surface in engagement with the downwardly facing inner surface 24*b* of a recess in the rocker 24. As so arranged plate 40 serves to provide an added degree of rigidity for the upper end of toggle 12 and the rocker 24 when taken in combination with the annular rib 12*c* and the associated annular groove 24*c* in the rocker. However, the retaining plate 40 serves another perhaps more important role than that of securing the rocker to the toggle. This plate 40 actually engages the upper end of the boss 22 of the switch case when the rocker is in either one of its two limit positions, and as so located the effect of downward pressure on the upper face of the rocker will not result in the toggle moving inwardly to separate shoulder 12*a* from bushing 20.

The plate 40 thus serves two functions, one to anchor the rocker 24 to the toggle 12, but perhaps more significantly the plate 40 prevents axial movement of the toggle relative to the switch case bushing or boss 22 at least when the rocker is in one of its two opposed limit positions.

Figure 2:
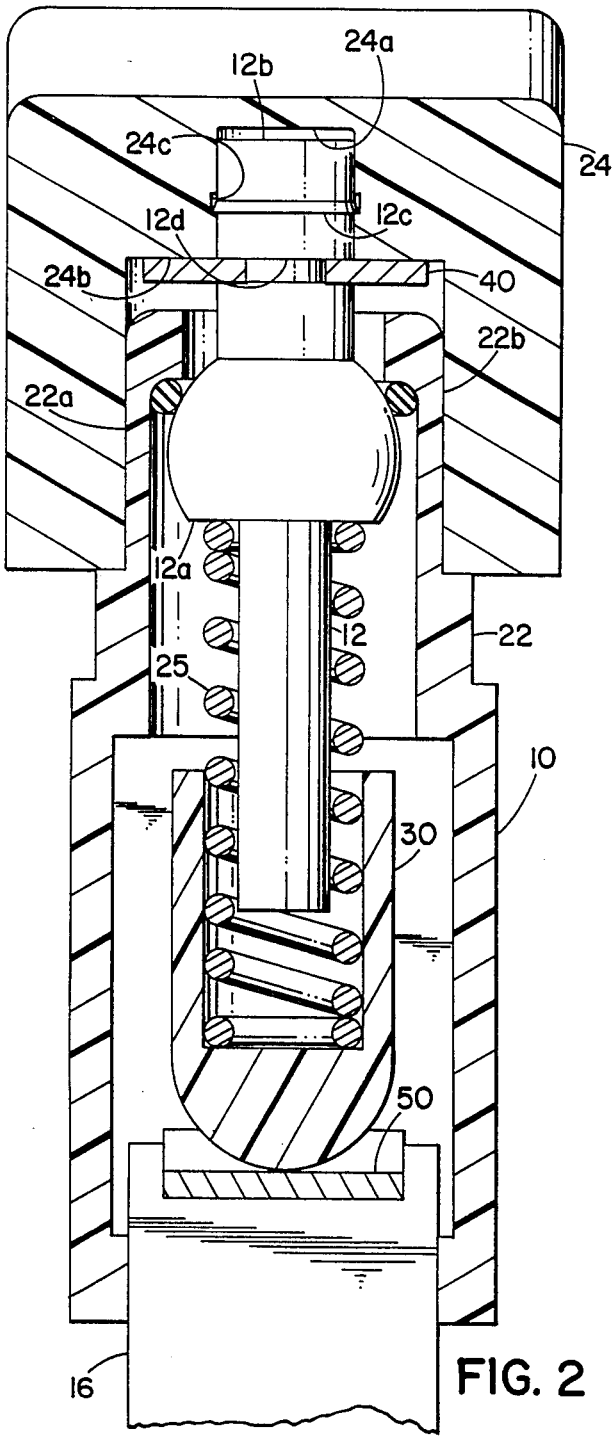
FIG. 2 is a vertical sectional view taken generally on the line 2—2 of FIG. 1.
Figure 3:
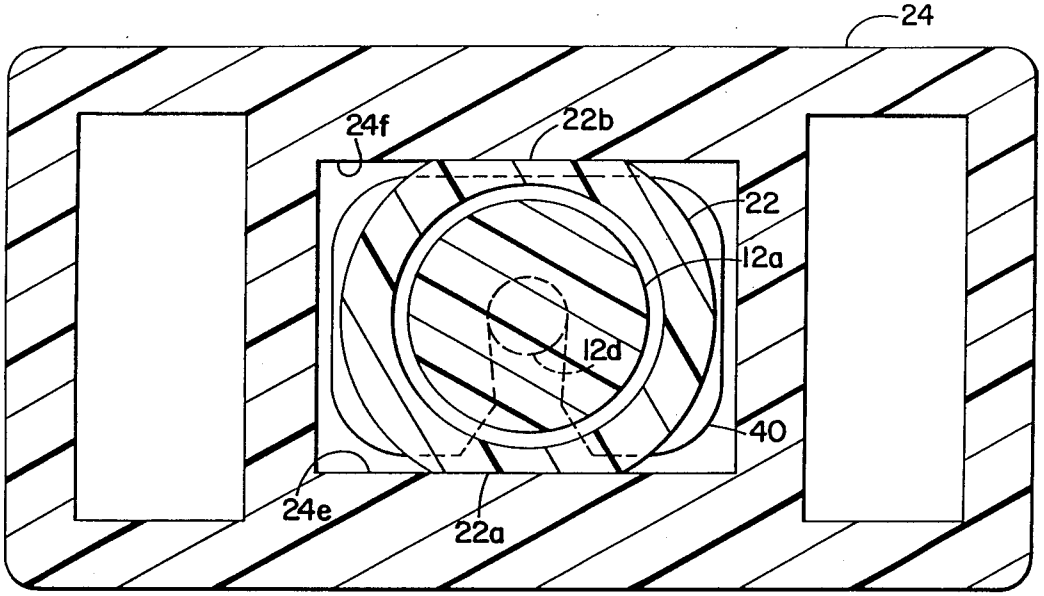
FIG. 3 is a horizontal sectional view taken generally on the line 3—3 of FIG. 1.

As best shown in FIG. 3 the rocker 24 has internally defined facing flat surfaces 24*e* and 24*f* which are adapted to engage the flats 22*a* and 22*b* on the boss 22 of the switch case cover. This feature assures that the rocker 24 is restricted against rotation relative to the longitudinal axis of the toggle. Thus the rocker 24 cannot cause inadvertent rotation of the axially symmetric toggle in the switch case. As best shown in FIG. 2 the rocker 24 is so much larger in size, both in width and length (See FIG. 1) than the toggle so that pressure exerted on the rocker during use of the switch could exert torsional forces on the toggle tending to rotate the toggle. Absent the action of flats 24*e* and 24*f* on the bushing 22 such forces would interfere with the normal pivoting motion of the rocker intended for normal operation of the switch.

DETAILED DESCRIPTION OF EMBODIMENT OF FIGS. 4 AND 5

Figure 4:
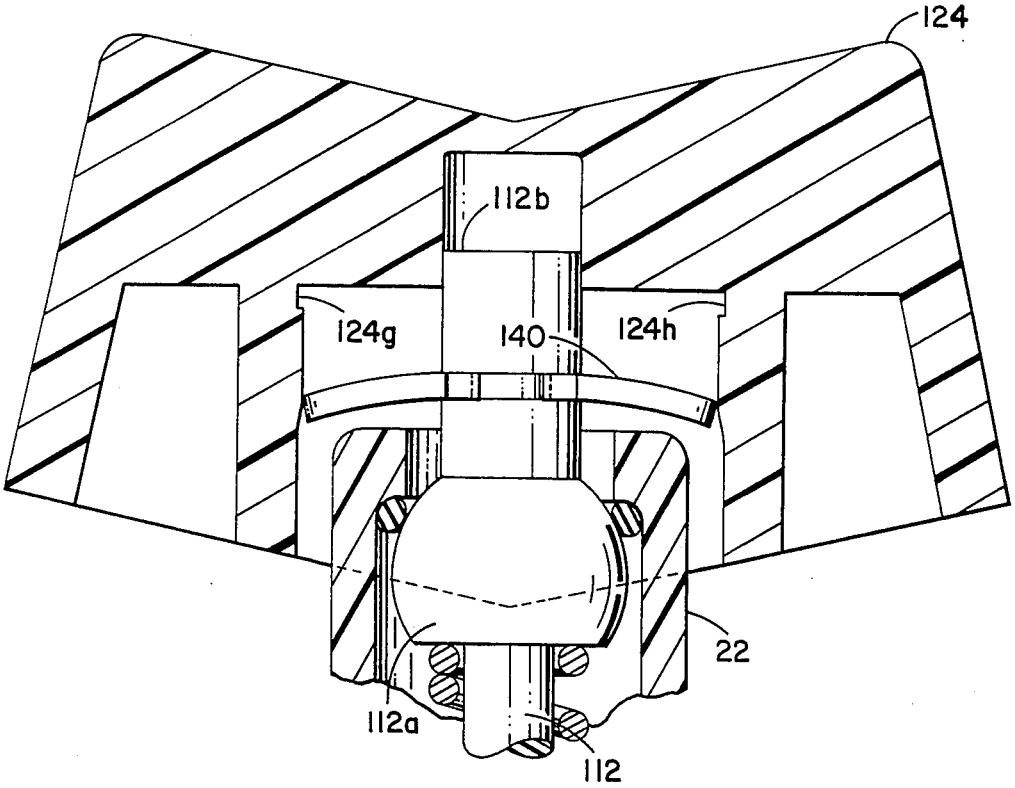
FIG. 4 is a view illustrating an alternative embodiment for the rocker actuator connection in a switch otherwise similar to that of FIG. 1, FIG. 4 illustrating the actuator and toggle at intermediate stage in the assembly process.
Figure 5:
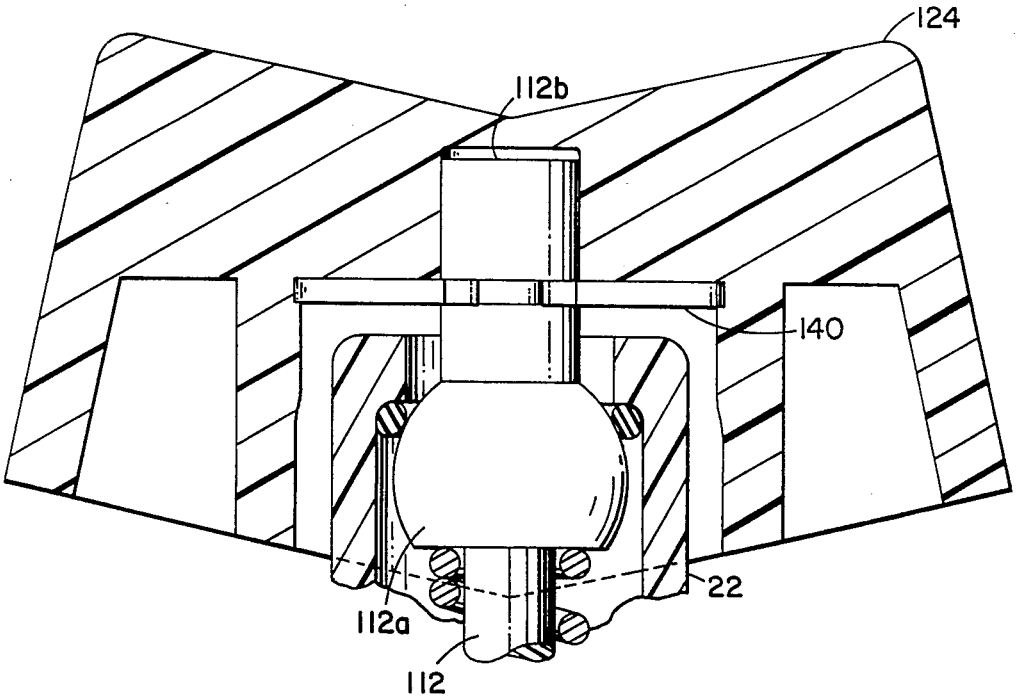
FIG. 5 is a view of the rocker actuator connection illustrated in FIG. 4 but showing the rocker in assembled relationship with the upper end of the toggle.

FIG. 4 and FIG. 5 show an alternative configuration for the assemblage of a rocker 124 of slightly different configuration from that illustrated and described previously with reference to FIGS. 1–3 under reference numeral 24. The toggle 112 is also similar to the toggle 12 illustrated in these views but does have minor variations in its geometry.

Figure 6:
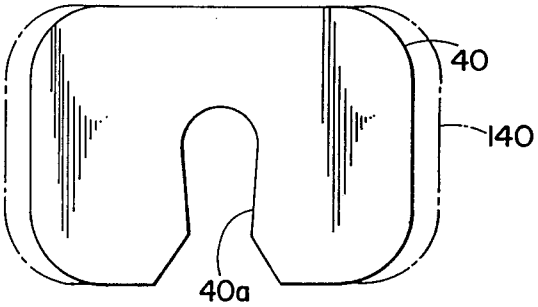
FIG. 6 is a plan view of the C-shaped retainer of FIGS. 1—3, and also shows the retainer of FIGS. 4 and 5 in broken lines.

FIG. 4 illustrates the toggle 112 in the process of being assembled with the rocker 124. A generally C-shaped retainer 140 is provided on the toggle post portion 112*b* as shown, and as described previously with reference to the plate 40 of the previous embodiment. However, the C-shaped retaining plate 140 of FIGS. 4 and 5 does differ from that described previously. FIG. 6 illustrates the differences wherein both the C-shaped retaining plate 40 of FIGS. 1–3 is shown as well as the plate 140 utilized in the FIG. 4 and FIG. 5 version. The latter plate 140 is illustrated in broken lines and designated 140. Both plates 40 and 140 have an opening 40*a* to one side in order to provide for convenient assembly of the plate with the toggle. This slot 40*a* is preferably tapered to provide a throat shape as shown in FIG. 6 to afford positive locking once the plate is assembled with the toggle. As shown in FIG. 6 the plate 140 is slightly longer than the plate 40 and FIG. 4 illustrates the reasons for this increase in length. As shown in FIG. 4 the retaining plate 140 is first assembled with the toggle 112 and then the rocker 124 is brought into assembly with the toggle and with the switch case as represented by the boss 22. FIG. 5 illustrates the plate 140 after it has been assembled with the rocker and in this view the extended end portions of the plate 140 can be seen to fit within slots 124*g* and 124*h* of the rocker with the result that the rocker 124 is very securely assembled to the toggle 112. It will be apparent from FIG. 5 that the plate 140 abuts the top of bushing 22 in this embodiment just as is the case with the plate 40 in FIG. 1, at least when the switch is in one of its two limit positions. As shown in FIGS. 4 and 5 the larger recess in the actuator has side walls that engage the C-shaped retaining plate end portions during assembly to provide an interference fit therewith such that the plate snaps into the groove as the actuator and plate are assembled with one another.

I claim:

1. In combination with an electrical switch of the type having an upstanding bushing with diametrically opposed flats and a movable toggle having a portion projecting upwardly through a top opening defined by an upper end of the bushing, the improvement comprising a one-piece plastic actuator for said switch toggle, said actuator having a downwardly open recess for snugly receiving the projecting portion of said toggle, said actuator also having a larger downwardly open recess having parallel inwardly facing side walls defining guide surfaces for engaging the flats of said upstanding bushing, and a retaining device provided between the upper end of said bushing and an inner end of said larger downwardly open recess, said retaining device being secured in an annular slot provided for this purpose in the projecting portion of the toggle, said retaining device comprising a C-shaped retaining plate of generally rectangular external configuration and having a side opening affording an interference fit with the annular groove in the toggle, said generally rectangular C-shaped retaining plate having opposed end portions that are adapted to be received in grooves provided for this purpose in an actuator portion defining said inner end of said larger recess, said actuator recess having end walls which engage said plate end portions during assembly to provide an interference fit therewith such that said plate end portions snap into the grooves as the actuator and plate are assembled with one another.

2. The combination of claim 1 wherein the projecting portion of the toggle so received in the downwardly open recess of the actuator defines an annular flange of tapered shape so as to afford entry of said flange into an annular groove provided for this purpose in the actuator, whereby to inhibit disassembly of the actuator from the toggle after the two have been so assembled.

* * * * *